United States Patent [19]

Aarts

[11] Patent Number: 4,899,788

[45] Date of Patent: Feb. 13, 1990

[54] APPARATUS FOR REMOVING A FAULTY WEFT YARN FROM A WEAVING SHED

[75] Inventor: Hubertus H. Aarts, Deurne, Netherlands

[73] Assignee: Sulzer Brothers Limited, Winterthur, Switzerland

[21] Appl. No.: 190,880

[22] Filed: May 6, 1988

[30] Foreign Application Priority Data

May 8, 1987 [CH] Switzerland ..... 01772/87

[51] Int. Cl.[4] ..... D03J 1/04

[52] U.S. Cl. ..... 139/116 A

[58] Field of Search ..... 139/1 R, 116.1, 429, 139/435, 450, 116.2

[56] References Cited

U.S. PATENT DOCUMENTS 4,529,010 7/1985 Aarts ..... 139/116
4,664,157 5/1987 Shin ..... 139/116
4,750,528 6/1988 Suwa ..... 139/116

FOREIGN PATENT DOCUMENTS 0100939 2/1984 European Pat. Off. .
3537714 4/1986 Fed. Rep. of Germany .
2527655 12/1983 France .

*Primary Examiner*—Henry S. Jaudon
*Attorney, Agent, or Firm*—Kenyon & Kenyon

[57] ABSTRACT

The arrangement for removing a faulty weft yarn from a shed comprises a manipulator for physically moving a yarn clamp carrier between a rest position and a yarn clamping position for engaging a weft yarn. A needle is provided on the carrier for releasing the weft yarn from the beat-up line of the cloth for delivery into the yarn clamp. A rotatable storage drum at a yarn release position winds on yarn from the yarn clamp for subsequent delivery to a suction tube for removal.

16 Claims, 3 Drawing Sheets

Figures 1, 1A, 1B, 1C:
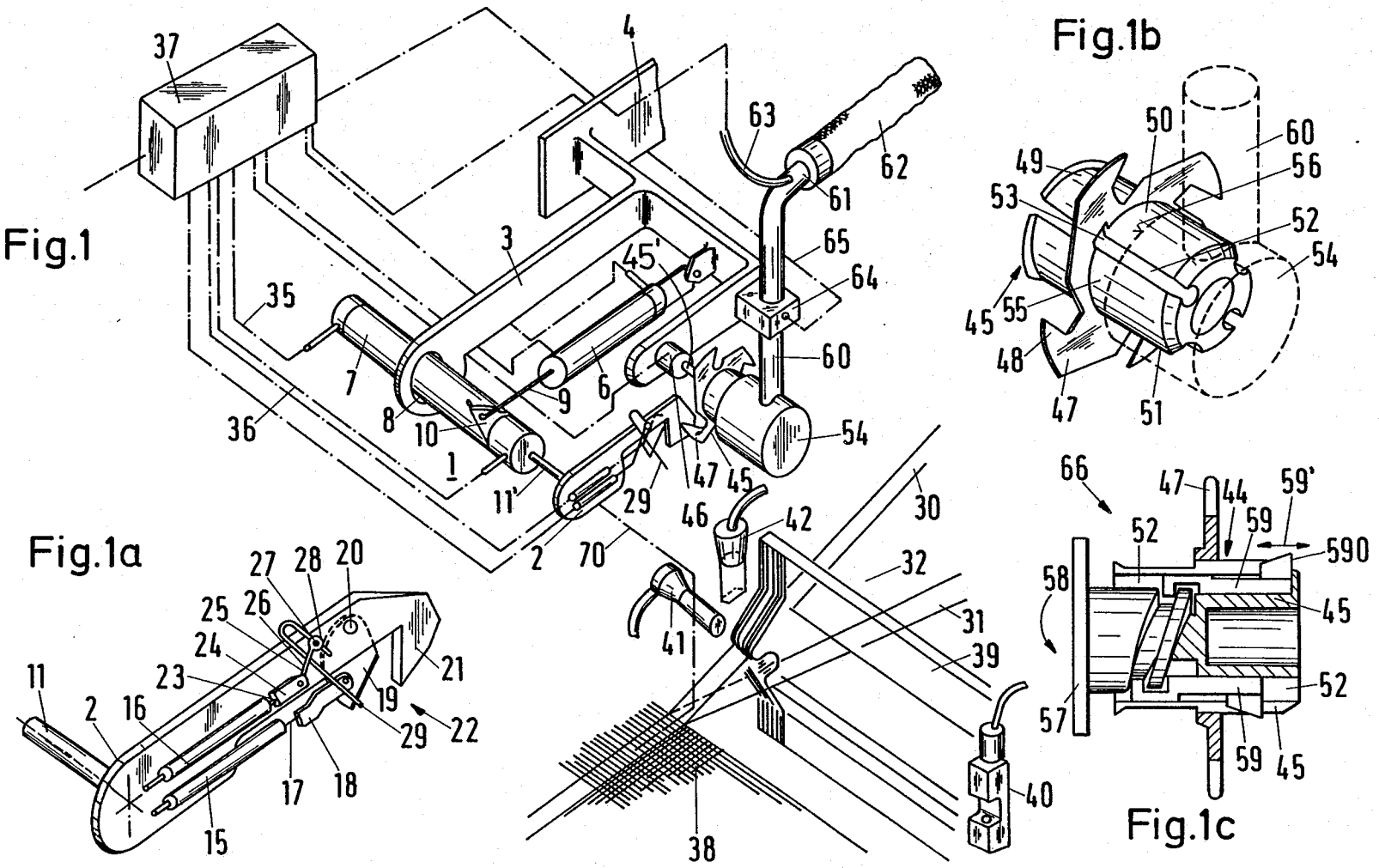

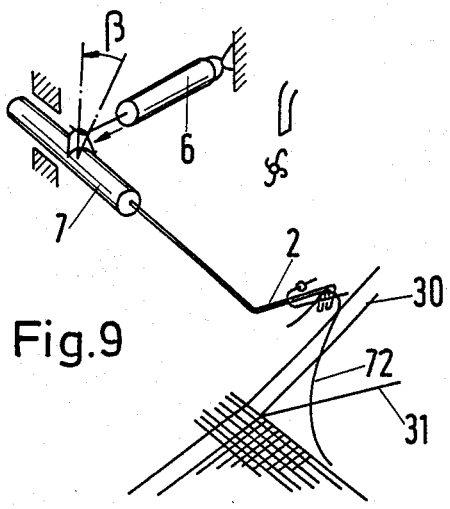
Fig.9
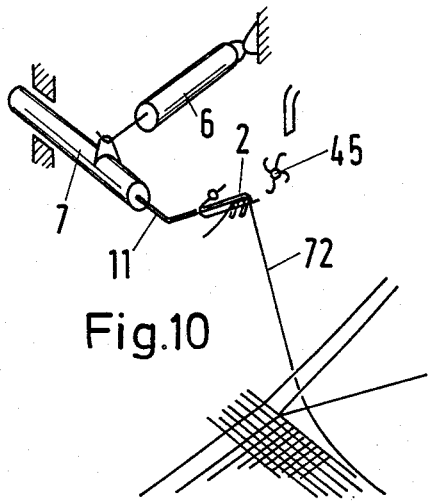
Fig.10
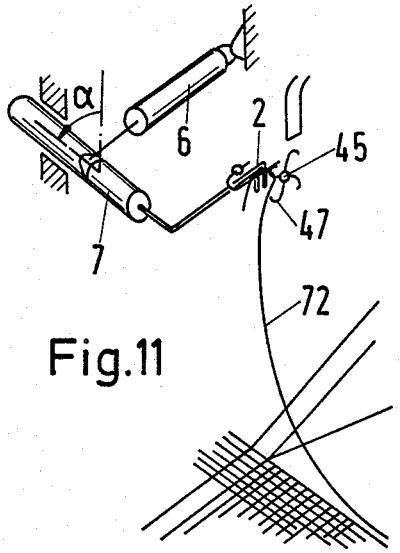
Fig.11
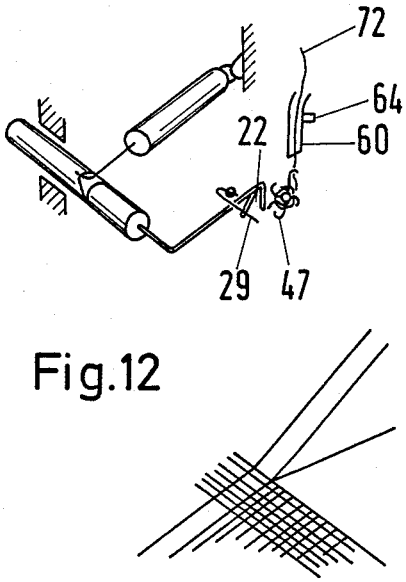
Fig.12
Fig.13
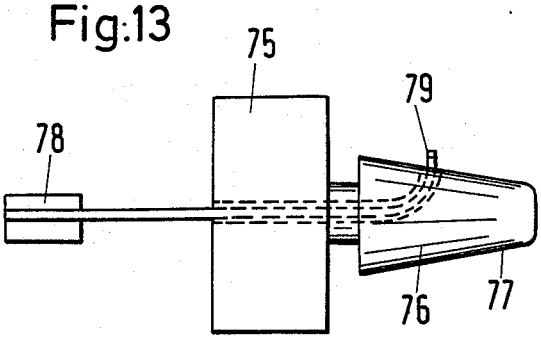
Fig.14
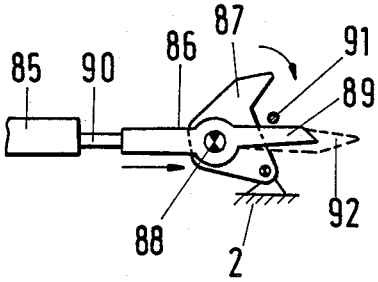

APPARATUS FOR REMOVING A FAULTY WEFT YARN FROM A WEAVING SHED

This invention relates to an apparatus for removing a faulty weft yarn from a weaving shed.

Heretofore, various types of devices and arrangements have been known for the removal of a faulty weft yarn from a shed of warp yarns in a weaving machine. For example, as described in German OS No. 3342398, an arrangement is described which employs a means for releasing the faulty weft yarn from the beating-up line of the cloth for subsequent removal. In this case, the means is in the form of vane which is reciprocated Via a flexible retractable strip through the shed over the whole weaving width. However, such means are not suitable for substantial weaving widths. In addition, the arrangement uses a yarn clamp which is controlled by a manipulator in order to engage one end of the released weft yarn and to move the yarn end before a mouth piece of a suction tube which draws the weft yarn out of the shed for removable purposes. However, with such an arrangement, a weft yarn experiences relatively substantial friction while moving through the shed. Hence, not all weft yarns can be removed in a reliable manner. More particularly, the manner of removal has not been particularly economical with respect to the consumption of air.

Accordingly, it is an object of the invention to provide an economical arrangement for removing faulty weft yarns from a weaving shed.

It is another object of the invention to be able to reliably remove faulty weft yarns from a weaving shed. It is another object of the invention to be able to remove faulty weft yarns from a weaving shed in a reliable manner without imposing large friction forces on the weft yarn.

It is another object of the invention to reduce the amount of suction air required for removing faulty weft yarns from a weaving shed.

Briefly, the invention provides an apparatus for removing a faulty weft yarn from a shed of warp yarns which includes a yarn clamp, a store means and means for removing a released yarn from the store means.

The yarn clamp is movable between a yarn clamping position in the shed and a yarn release position outside the shed while the store means is positioned at the yarn release position for receiving a released yarn from the clamp.

The apparatus also includes a manipulator for moving the Yarn clamp among a rest position, the yarn clamping position and the yarn release position. Further ,the apparatus includes means for releasing a weft yarn from a beat-up line of a cloth in to the Clamp with the clamp in the clamping position.

The store means which is positioned at the yarn release position may include a drum for winding of the released yarn thereon. In addition, the store means includes a weft yarn catch disc on the drum which divides the drum into two parts and Which serves to catch the yarn brought to the drum by the yarn clamp. During rotation of the drum, the disc causes the weft yarn to wind onto the drum.

The means for removing the released yarn may include a tube which surrounds at least one part of the drum as well as a suction tube extending therefrom so that the weft yarn can be drawn off the drum and expelled.

These and other objects and advantages of the invention will become more apparent from the following detailed description taken in conjunction with the accompanying drawings wherein:

FIG. 1 illustrates a perspective view of an arrangement according to the invention;

FIG. 1*a* illustrates a perspective view of a yarn clamp carrier constructed in accordance with the invention;

FIG. 1*b* illustrates a perspective view of a storage s drum constructed in accordance with the invention;

FIG. 1*c* illustrates a partial cross-sectional view of a store means and a weft yarn feeding mechanism constructed in accordance with the invention;

FIGS. 2 to 12 diagrammatically illustrate the various motions performed by the components of the apparatus of FIG. 1;

FIG. 13 illustrates a modified yarn clamp carrier constructed in accordance with the invention; and FIG. 14 illustrates a weft yarn cutter secured to a yarn clamp carrier in accordance with the invention.

Referring to FIG. 1, the apparatus for removing a faulty weft yarn from a shed 32 warp yarns 31 includes a manipulator 1 for actuating and controlling the movement of a yarn clamp carrier 2. As indicated, the manipulator 1 is disposed in a frame 3 secured to the weaving machine frame 4 and is formed of, for example, two pneumatic actuators 6, 7.

One pneumatic actuator 7 is rotatably mounted about a longitudinal axis within a bore 8 of the frame 3 and is rotatable by means of the other actuator 6 which is pivotally connected to the frame 3 at a proximal end. To this end, the actuator 6 has a reciprocable piston rod 9 which is connected to a radially disposed lever arm 10 on the actuator 7. The actuator 7 has a reciprocably mounted piston rod 11 which carries the yarn clamp carrier 2. Thus, upon reciprocation of the piston rod 9, the actuator 7 can be rotated about its longitudinal axis.

Referring to FIG. 1*a*, the yarn clamp carrier 2 has a pair of mini actuators 15, 16 mounted thereon. One actuator 15 has a piston rod 17 which is connected by means of a fork 18 to a jaw 19 which is pivotally mounted about a pin 20 on the carrier 2. In addition, the carrier 2 has a projection 21 opposite the jaw 19 to form a yarn clamp 22 therewith.

The mini-actuator 16 has a reciprocable piston rod 23 which is connected to a fork 24 Which, in turn, pivotally receives one end 25 of a pivotal lever 26. The other end of the lever 26 is pivotally mounted on a pin 27 secured to the carrier 2. The lever 26 also has a clamp 28 to which a hair pin-shaped needle 29 is secured. As indicated, the needle 29 is rotatably mounted on the carrier 2 so as to be moved by the mini-actuator 16 in a plane parallel to the direction of the warps 30, 31 of a weaving shed 32 (see FIG. 1).

As indicated in FIG. 1, all of the actuators 6, 7, 15, 16 are connected to a programmed control unit 37 by way of control lines as indicated in chain-dotted lines. For example, the actuator 7 is connected to the control unit 37 by way of control lines 35, 36.

As indicated in FIG. 1, the manipulator 1 is disposed on the picking side of the weaving machine opposite the shed 32 and adjacent to the woven cloth 38. A reed 39 is also present in the shed 32 along with a weft stop motion 40 for sensing a faulty weft yarn. A main picking nozzle 41 is also disposed opposite the shed 32 for the picking of a weft yarn while a weft yarn deflector 42 is disposed between the picking nozzle 41 and the shed 32 in order to blow weft yarn downwardly to prevent picking of a yarn when required.

Figure 2:
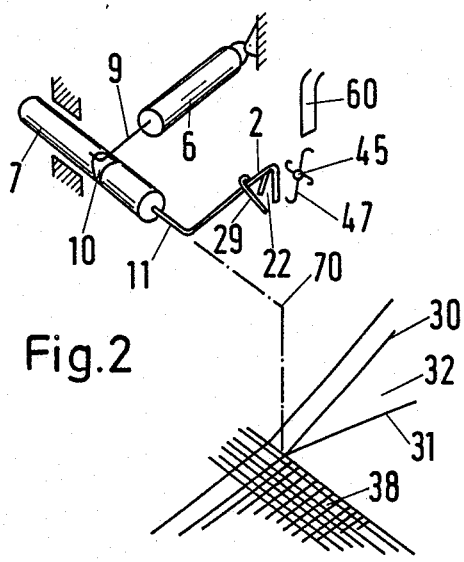
Figure 5:
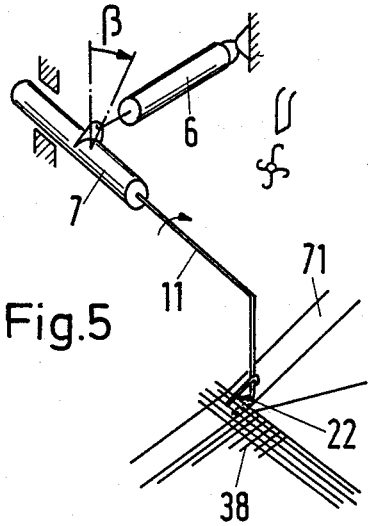
Figure 6:
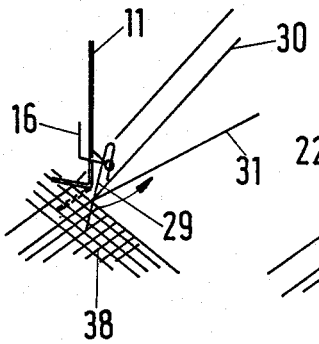
Figure 7:
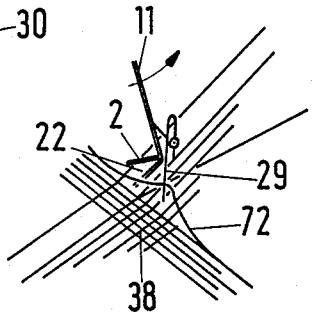

The manipulator 1 serves to move the yarn clamp 22 between a rest position as shown in FIGS. 1 and 2, a yarn clamping position as shown in FIGS. 5, 6 and 7 and a yarn release position as shown in FIG. 11.

Referring to FIG. 1, the apparatus for removing a faulty yarn also includes a store means in the form of a storage drum 45 at the yarn release position of the yarn clamp 22 in order to receive a yarn from the clamp 22. As indicated, the storage drum 45 is mounted on a shaft 45' driven by an electric motor 46 which is mounted on the frame 3.

Referring to FIG. 1*b*, the storage drum 45 includes a catcher disc 47 having a plurality of catcher hooks 48 thereon for engaging a weft yarn delivered thereto. The disc 47 is mounted on the drum 45 so as to divide the surface of the drum into two parts 49, 50. In addition, the peripheral surface 51 of the drum 45 is formed with a plurality of axial grooves 52 for purposes as described below While the disc 47 is provided with recesses 53 in alignment with the respective grooves 52.

Referring to FIGS. 1 and 1*b*, the apparatus also includes a means for removing the released yarn from the store means, that is, from the storage drum 45. This removing means is in the form of a tube 54 which extends around one drum part 50 to an extent such that a portion 55 of the drum 45 between a tube end 56 and the disc 47 remains unsurrounded and accessible. A suction tube 60 also extends from the tube 54 and communicates at the distal end with a collector 62 for weft yarns. A driving tube 63 is connected to the suction tube 60 in order to force air into the tube 60 in order to create a suction force therein. A sensor 64 is also disposed within the tube 60 to produce a signal after the passage of the end of a removed weft yarn to indicate that the weaving machine is ready to resume operation. This signal passes by way of a line 65 to the control unit 37.

Referring to FIG. 1*c*, a feeding mechanism 66 is disposed within the drum 45 in order to ensure removal of the windings of weft yarn into the tube 54 connected to the suction tube 60. As indicated, the feeding mechanism 66 includes a plurality of feed slide blocks 59 each of which is slidably mounted within a groove 52 of the drum 45. In addition, a part 590 of each block 59 extends radially beyond the surface 44 of the drum 45 so as to engage with weft yarn windings on the drum surface 44. In addition, a cam drum 57 is rotatably mounted within the drum 45 to rotate in the direction indicated by the arrow 58 and to engage With the slide blocks 59 in order to reciprocate the slide blocks 59 in the direction indicated by the arrow 59, The operation of the apparatus will be described hereinafter with reference to FIGS. 2 to 12, starting from the position of the arrangement shown in FIGS. 1 and 2 and for normal operation of the weaving machine.

When the weft stop motion 40 at the end of the tunnel reed (FIG. 1) detects a faulty weft yarn, a fault signal is generated to actuate the weft yarn deflector 42 in order to blow any succeeding weft yarn downwardly to prevent picking. At the same time, the weaving machine is stopped. Since the faulty weft yarn has already been woven into the warp, the main weaving machine shaft is turned back until the faulty weft yarn has been disengaged from the warp yarns 30, 31. A controlled signal is then transmitted to the control unit 37 to initiate the following sequential movement patterns.

Figure 3:
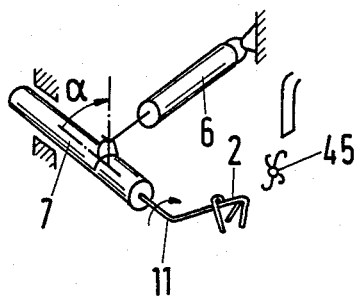

FIG. 3: Actuator 6 rotates actuator 7 clockwise through an angle o so that the yarn clamp carrier 2 can move below the drum 45.

Figure 4:
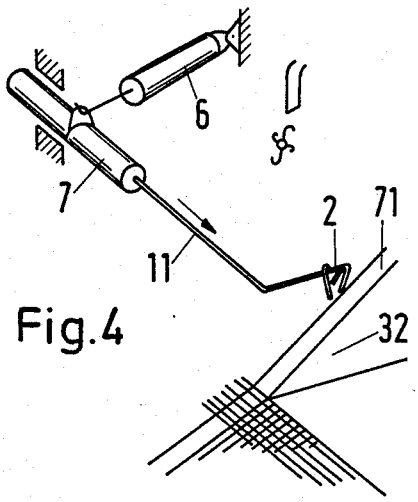

FIG. 4: Actuator 7 extends piston rod 11 and moves carrier 2 through a distance 70 (FIGS. 1 and 2) to above an auxiliary edge 71 of the shed 32.

FIG. 5: Actuator 6 further rotates actuator 7 clockwise through an angle $\beta$ until the yarn clamp 22 is disposed in the edge 71 and the needle 29 is disposed on the cloth 38.

FIG. 6: Mini-actuator 16 on the carrier 2 rotates needle 29 anticlockwise —i.e. in the direction of the warp yarns 30, 31, such that the needle 29 acts as a means for releasing the weft yarn 72 from the beat-up line of the cloth 38.

FIG. 7: Simultaneously with the movement of the needle 29, the actuator 7 rotates the carrier 2 away from the cloth 38.

Figure 8:
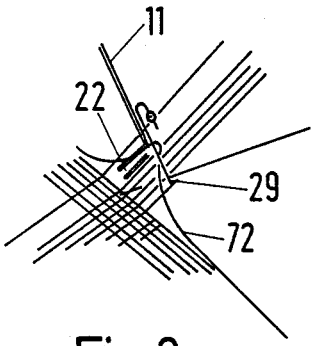

FIG. 8: The needle 29 moves the weft yarn 72 to be removed into the yarn clamp 22. The mini-actuator 15 closes the yarn clamp 22 so that the wet yarn 72 is clamped in the clamp 22.

FIG. 9: The actuator 6 rotates the actuator 7 anticlockwise through an angle $\beta$ so that the carrier 2 with the clamped weft yarn 72 moves away from the warp 30, 31 into the same position as in FIG. 4.

FIG. 10: The actuator 7 draws the carrier 2 back and past the storage drum 45. The carrier 2 is again in the position shown in FIG. 3.

FIG. 11: The actuator 6 rotates the actuator 7 anticlockwise through the angle $\alpha$ and moves the carrier 2 with the weft yarn 72 towards the catcher disc 47 of the storage drum 45.

FIG. 12: The control unit 37 energizes the electric motor 46 and the drum 45 starts to turn. The weft yarn 72 is engaged by the disc 47 and wound onto the storage drum 45 (FIG. 1*b*).As shown in FIGS. 9 to 12, only a small part of the yarn, namely the end portion on the left side of the disc 47 is wound on the left part 49 of the drum 45 while the rest is to be wound on the right side. This is because the hook 48 catches the weft yarn near the entrance of the shed and both portions of the weft yarn to the left and to the right of the hook 48 are wound on the respective portions 49, 50 of the disc 47.

After a few turns have been wound onto the drum 45, the mini-actuator 15 opens the yarn clamp 22. The mini-actuator 16 returns the needle 29 to its initial position. The winding-on of the weft yarn continues on the part 50 to the right of the disc 47 as shown in FIG. 1*b*. The number of turns needed—approximately 1.5 turns—in the part 49 is such as to ensure that after the yarn clamp 22 opens, sufficient friction is available to ensure that the weft yarn does not slip during continued winding on the part 50. After the winding-on of the weft yarn, the feeding mechanism 66 on the drum 45 comes into operation, as shown in FIG. 1*c*. By means of the drum 57, the feed slide blocks 59 move in the grooves 52 of the drum 45 as indicated by the arrow 59'. The part 590 of each slide block 59 extending radially beyond the surface 44 of the drum 45 causes the yarn turns on the surface 44 to move to the right (FIG. 1*c*). The turns thus reach the tube 54 in which they are engaged by the airstream and transferred to the suction tube 60 and subsequently passed into the collector 62.

To facilitate the transfer of the weft yarn from the drum surface 44 to the tube 54, the drum 45 can be rotated in the direction opposite to that associated with the winding-on z of the weft yarn.

Once the end of the weft yarn 72 has passed by the sensor 64 in the tube 60, the sensor 64 produces a signal for the control unit 37 indicating that the weaving machine is ready to resume operation. The control unit 37 transmits a start signal to the drive control and the loom restarts.

Referring to FIG. 13, the store means for receiving a released yarn may alternatively be in the form of a drum 76 having a conical surface 77. As indicated, the drum 76 is driven by an electric motor 75 and contains a catch pin 79. The catch pin 79 is, in turn, connected to an actuator 78 for moving the pin 79 between an extended position projecting from the conical surface 77, as shown, and a retracted position within the drum 76. In operation, after the first few turns of weft Yarns have been wound onto the drum 76 to the left of the pin 79, as viewed, the actuator 78 retracts the pin 79 below the surface 77. Thereafter, winding-on continues to the right of the pin 79.

Referring to FIG. 14, the yarn clamp carrier 2 may also be provided with a third actuator 35 for operating a cutter or shears 86. As indicated, the shears 86 includes a shear blade 87 of plate-like shape which is pivotally mounted by a pin 88 on a shear blade 89 connected to the actuator 85. In addition, the shear blade 87 is connected to a pin on the carrier 2 so as to rotate in the direction indicated by the arrow relative to the shear blade 89. The actuator 85 has a piston rod 90 which is reciprocable so that when extended, the shear blade 87 is rotated clockwise, as indicated to sever a weft yarn 91 before the yarn clamp releases the yarn. A stirrup 92 is also secured to the bottom shear blade 89 to facilitate catching of the weft yarn.

The invention thus provides an apparatus for removing a faulty weft yarn from a weaving shed in a reliable and economic manner. In this respect, the release means, i.e. the needle 29, need merely expose the weft yarn end for clamping. Further, no suction is required during removal of the weft yarn from the shed since the storage drum serves to remove the weft yarn from the shed. After the yarn has been removed, suction can be initiated for removal of the yarn wound-on at the storage drum.

What is claimed is:

1. An apparatus for removing a faulty weft yarn from a shed of warp yarns, said apparatus comprising a yarn clamp;

a manipulator for moving said yarn clamp among a rest position, a yarn clamping position and a yarn release position;

means for releasing a weft yarn from a beat-up line of a cloth into said clamp with said clamp in said clamping position;

store means at said yarn release position for receiving a released yarn from said clamp, said store means including a drum for winding of the released yarn thereon and a weft yarn catcher disc on said drum for dividing said drum into two parts; and means for removing the released yarn from said store means.

2. An apparatus as set forth in claim 1 wherein said means for removing the released yarn includes a first tube surrounding one of said parts of said drum and a suction tube extending from said first tube for removing a weft yarn there through.

3. An apparatus as set forth in claim 1 wherein said drum has at least one axial groove in a surface thereof.

4. An apparatus as set forth in claim 3 wherein said disc has a recess adjacent said drum surface in alignment with said groove.

5. An apparatus as set forth in claim 1 which further comprises a weft yarn clamp carrier mounting said yarn clamp and said means for releasing a weft yarn.

6. An apparatus for removing a faulty weft yarn from a shed of warp yarns, said apparatus comprising;

a yarn clamp;

a manipulator for moving said yarn clamp among a rest position, a yarn clamping position and a yarn release position;

means for releasing a weft yarn from a beat-up line of a cloth into said clamp with said clamp in said clamping position;

store means at said yarn release position for receiving a released yarn from said clamp, said store means including a rotatably reversible drum for winding of the released yarn thereon whereby in one direction of rotation said drum winds a faulty yarn thereon from said clamp and in an opposite direction of rotation said drum unwinds a weft yarn therefrom; and means for removing the released yarn from said store means.

7. An apparatus for removing a faulty weft yarn from a shed of warp yarns, said apparatus comprising;

a yarn clamp;

a manipulator for moving said yarn clamp among a rest position, a yarn clamping position and a yarn release position;

means for releasing a weft yarn from a beat-up line of a cloth into said clamp with said clamp in said clamping position;

store means at said yarn release position for receiving a released yarn from said clamp, said store means including a drum for winding of the released yarn thereon, said drum having a conical surface, a catch pin and an actuator for moving said pin between a retracted position in said drum and an extended position projecting from said conical surface; and means for removing the released yarn from said store means.

8. An apparatus for removing a faulty weft yarn from a shed of warp yarns, said apparatus comprising;

a yarn clamp;

a manipulator for moving said yarn clamp among a rest position, a yarn clamping position and a yarn release position;

means for releasing a weft yarn from a beat-up line of a cloth into said clamp with said clamp in said clamping position;

store means at said yarn release position for receiving a released yarn from said clamp, and means for removing the released yarn from said store means including a first tube for received a released yarn from said store means and a suction tube extending from said first tube for removing a weft yarn therethrough.

9. An apparatus as set forth in claim 8 which further comprising a weft yarn collector connected to said suction tube to receive weft yarn therefrom.

10. An apparatus as set forth in claim 8 which further comprises a sensor in said suction tube for generating a single in response to passage of a weft yarn thereby to produce a start signal for a weaving machine.

11. An apparatus for removing a faulty weft yarn from a shed of warp yarns, said apparatus comprising a yarn clamp movable between a yarn clamping position in the shed and a yarn release position outside the shed;

store means at said yarn release position for receiving a released yarn from said clamp, said store means including a drum for winding of the released yarn thereon and a weft yarn catcher disc on said drum for engaging a yarn in said clamp in said release position for winding on said drum; and means for removing the released yarn from said store means.

12. An apparatus as set forth in claim 11 wherein said means for removing the released yarn includes a fixed tube surrounding one part of said drum and a suction tube extending from said fixed tube for removing a weft yarn therethrough.

13. An apparatus for removing a faulty weft yarn from a shed of warp yarns, said apparatus comprising a yarn clamp;

a weft yarn clamp carrier mounting said yarn clamp;

a manipulator for moving said yarn clamp among a rest position, a yarn clamping position and a yarn release position;

means mounted on said carrier for releasing a weft yarn from a beat-up line of a cloth into said clamp with said clamp in said clamping position, said means including a needle rotatably mounted on said carrier and an actuator on said carrier for moving said needle in a plane parallel to the warp direction of the shed;

store means at said yarn release position for receiving a released yarn from said clamp; and means for removing the released yarn from said store means.

14. An apparatus for removing a faulty weft yarn from a shed of warp yarns, said apparatus comprising a carrier;

a yarn clamp mounted on said carrier, said yarn clamp including a projection on said carrier, a jaw rotatably mounted on said carrier opposite said projection for clamping a weft yarn therebetween and an actuator for moving said jaw relative to said projection;

a manipulator for moving said yarn clamp among a rest position, a yarn clamping position and a yarn release position;

means mounted on said carrier for releasing a weft yarn from a beat-up line of a cloth into said clamp with said clamp in said clamping position;

store means at said yarn release position for receiving a released yarn from said clamp; and means for removing the released yarn from said store means.

15. An apparatus for removing a faulty weft yarn from a shed of warp yarns, said apparatus comprising a yarn clamp movable between a yarn clamping position in the shed and a yarn release position outside the shed;

store means at said yarn release position for receiving a released yarn from said clamp, said store means including a drum for winding of the released yarn thereon, said drum having at least one axial slot in a surface thereof and a slider reciprocably mounted therein for expelling yarn windings from said drum; and means for removing the released yarn from said drum of said store means.

16. An apparatus for removing a faulty weft yarn from a shed of warp yarns, said apparatus comprising a yarn clamp movable between a yarn clamping position in the shed and a yarn release position outside the shed;

store means at said yarn release position for receiving a released yarn from said clamp, said store means including a drum for winding of the released yarn thereon, said drum having a conical surface, a catch pin and an actuator for moving said pin between a retracted position in said drum and an extended position projecting from said conical surface; and means for removing the released yarn from said store means.

* * * * *

UNITED STATES PATENT AND TRADEMARK OFFICE

CERTIFICATE OF CORRECTION

PATENT NO. : 4,899,788

DATED : Feb. 13, 1990

INVENTOR(S) : HUBERTUS H. AARTS

It is certified that error appears in the above-identified patent and that said Letters Patent is hereby corrected as shown below:

Column 1, line 14 "Via" should be -via-
Column 1, line 34 before "It is another..." insert for new paragraph-
Column 1, line 51 "Yarn" should be -yarn-
Column 1, line 54 "Clamp" should be -clamp-
Column 1, line 60 "Which" should be -which-
Column 2, line 9 "storage s" should be -storage-
Column 2, line 22 "32 warp" should be -32 of warp-
Column 2, line 47 "Which" should be -which-
Column 3, line 21 "While" should be -while-
Column 3, line 51 "With" should be -with-
Column 3, line 53 "59," should be -59'.-
Column 4, line 2 "0" should be $\alpha$-
Column 4, line 68 "cancel "z"
Column 5, line 15 "Yarns" should be -yarns-
Column 5, line 66 "there through" should be -therethrough-
Column 6, line 58 "received" should be -receiving-
Column 6, line 63 "comprising" should be -comprises-
Column 6, line 67 "single" should be -signal- Signed and Sealed this Thirtieth Day of July, 1991

*Attest:*

*Attesting Officer*

HARRY F. MANBECK, JR.

*Commissioner of Patents and Trademarks*